US011047555B1

(12) United States Patent
Yang

(10) Patent No.: US 11,047,555 B1
(45) Date of Patent: Jun. 29, 2021

(54) LOW PROFILE LIGHT MOUNTING ASSEMBLY

(71) Applicant: Nathan Yang, Surrey (CA)

(72) Inventor: Nathan Yang, Surrey (CA)

( * ) Notice: Subject to any disclaimer, the term of this patent is extended or adjusted under 35 U.S.C. 154(b) by 0 days.

(21) Appl. No.: 16/989,322

(22) Filed: Aug. 10, 2020

(51) Int. Cl.

| | |
|---|---|
| ***F21V 21/04*** | (2006.01) |
| ***F21S 8/02*** | (2006.01) |
| ***F21V 3/00*** | (2015.01) |
| ***F21Y 115/10*** | (2016.01) |

(52) U.S. Cl.
CPC ..... *F21V 21/04* (2013.01); *F21S 8/02* (2013.01); *F21V 3/00* (2013.01); *F21Y 2115/10* (2016.08)

(58) Field of Classification Search
CPC ..... F21V 21/04; F21V 21/046; F21V 23/003; F21V 23/008; F21S 8/02; F21S 8/04
See application file for complete search history.

(56) References Cited

U.S. PATENT DOCUMENTS 9,010,956 B1 * 4/2015 Davis ..... F21V 17/06 362/147
2013/0250586 A1 * 9/2013 Sasaki ..... F21V 17/002 362/373
2013/0322069 A1 * 12/2013 Liao ..... F21S 8/02 362/235
2014/0268797 A1 * 9/2014 Gabrius ..... F21V 29/713 362/294
2017/0082265 A1 * 3/2017 Xie ..... F21V 23/005
2017/0343190 A1 * 11/2017 Georgiev ..... F21V 17/02
2019/0203894 A1 * 7/2019 Zeng ..... F21V 29/70
2020/0271291 A1 * 8/2020 Ward ..... F21V 21/044

* cited by examiner

*Primary Examiner* — William N Harris
(74) *Attorney, Agent, or Firm* — Gulf Coast Intellectual Property Group

(57) ABSTRACT

A light and mounting assembly that is configured to be operably coupled to a conventional electrical junction box and further provide an ability to rotationally position the light ensuing installation. The light and mounting assembly includes an outer housing forming an interior volume wherein the interior volume includes a lighting element. The outer housing has mounted to the upper surface thereof a mounting assembly. The mounting assembly includes an inner housing wherein the inner housing has an outer ring mount member surroundably present thereon. The outer ring mount member includes a wall member having an outer surface and an inner surface. At least one groove is formed on the inner surface. A clip assembly is superposed the inner housing wherein the clip assembly includes securing members at opposing ends thereof. The securing members have a leading edge configured to be operably coupled to the at least one groove.

12 Claims, 3 Drawing Sheets

LOW PROFILE LIGHT MOUNTING ASSEMBLY

FIELD OF THE INVENTION

The present invention relates generally to lighting assemblies, more specifically but not by way of limitation, a light assembly having a mount configured to provide a technique to mount a light without a requirement for tools wherein the light mount assembly can be used for light configurations such as but not limited to low profile LED lights and further is configured to provide rotational position adjustment subsequent being secured in place.

BACKGROUND

LED lights and lighting apparatus are known in the art. LED lights and other lights are commercially available in numerous alternate embodiments such as but not limited to wall and ceiling fixtures. The aforementioned have various techniques in which to be installed wherein some installations can be direct mounted to surfaces such as but not limited to walls and some fixtures are configured to be operably coupled with junction boxes. For either of the foregoing mounting styles it is typical that a portion of the light housing is directly mounted to the wall/ceiling or to the junction box utilizing a mechanical fastener such as but not limited to screws.

The aforementioned conventional mounting assemblies provide several disadvantages that are undesirable by consumers and are further deficient for particular types of lighting styles. By way of example but not limitation, for some lighting styles it is desired to mount the fixture to ensure a low profile. In order to achieve the aforementioned both the housing design and mount assembly require a unique design. Many conventional mounting assemblies do not engage with either a wall/ceiling or a junction box that assists in ensuring the profile of the light remains as low as desired. Furthermore, most conventional mounting techniques typically result in securing a portion of the mount to a junction box. Subsequent mounting to the junction box, the assembly is immovable which can be undesirable for certain light fixtures wherein a desired orientation is required but a fixed mount inhibits the ability to rotationally adjust the position of the light ensuing installation.

It is intended within the scope of the present invention to provide a low profile mounting assembly to include a light fixture wherein the mounting assembly of the present invention provides the ability to mount without utilization of fasteners and further provides the ability to rotationally adjust the light ensuing installation.

SUMMARY OF THE INVENTION

It is the object of the present invention to provide a low profile light and mounting assembly that provides an ability to rotationally adjust the light ensuing installation wherein the present invention includes a light housing and a mounting assembly.

Another object of the present invention is to provide a low profile hardware free light and integrated mounting assembly wherein the mounting assembly is integrated with the light housing and extends outward from the upper surface thereof.

A further object of the present invention is to provide a low profile light and mounting assembly that provides an ability to rotationally adjust the light ensuing installation wherein the mounting assembly is configured to be operably journaled into a conventional electrical junction box.

Still another object of the present invention is to provide a low profile hardware free light and integrated mounting assembly wherein the mounting assembly includes an outer ring mount member that is configured to be circumferentially mounted to the mounting assembly and secured thereto.

An additional object of the present invention is to provide a low profile light and mounting assembly that provides an ability to rotationally adjust the light ensuing installation that further includes a clip assembly wherein the clip assembly is secured to the upper surface of the mounting assembly.

Yet a further object of the present invention is to provide a low profile hardware free light and integrated mounting assembly wherein the clip assembly includes biasly mounted securing members on opposing sides thereof.

Another object of the present invention is to provide a low profile light and mounting assembly that provides an ability to rotationally adjust the light ensuing installation wherein the outer ring mount member further includes grooves formed in the interior surface thereof.

An alternate object of the present invention is to provide a low profile hardware free light and integrated mounting assembly wherein the securing members are operable to be slidably engaged in the grooves in the interior surface of the outer ring mount member.

Still a further object of the present invention is to provide a low profile light and mounting assembly that provides an ability to rotationally adjust the light ensuing installation wherein an embodiment of the light housing can include a LED tape light, a reflector member and a light guide with diffuser lens.

A further object of the present invention is to provide a low profile hardware free light and integrated mounting assembly wherein the light housing can be provided in alternate shapes and styles.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
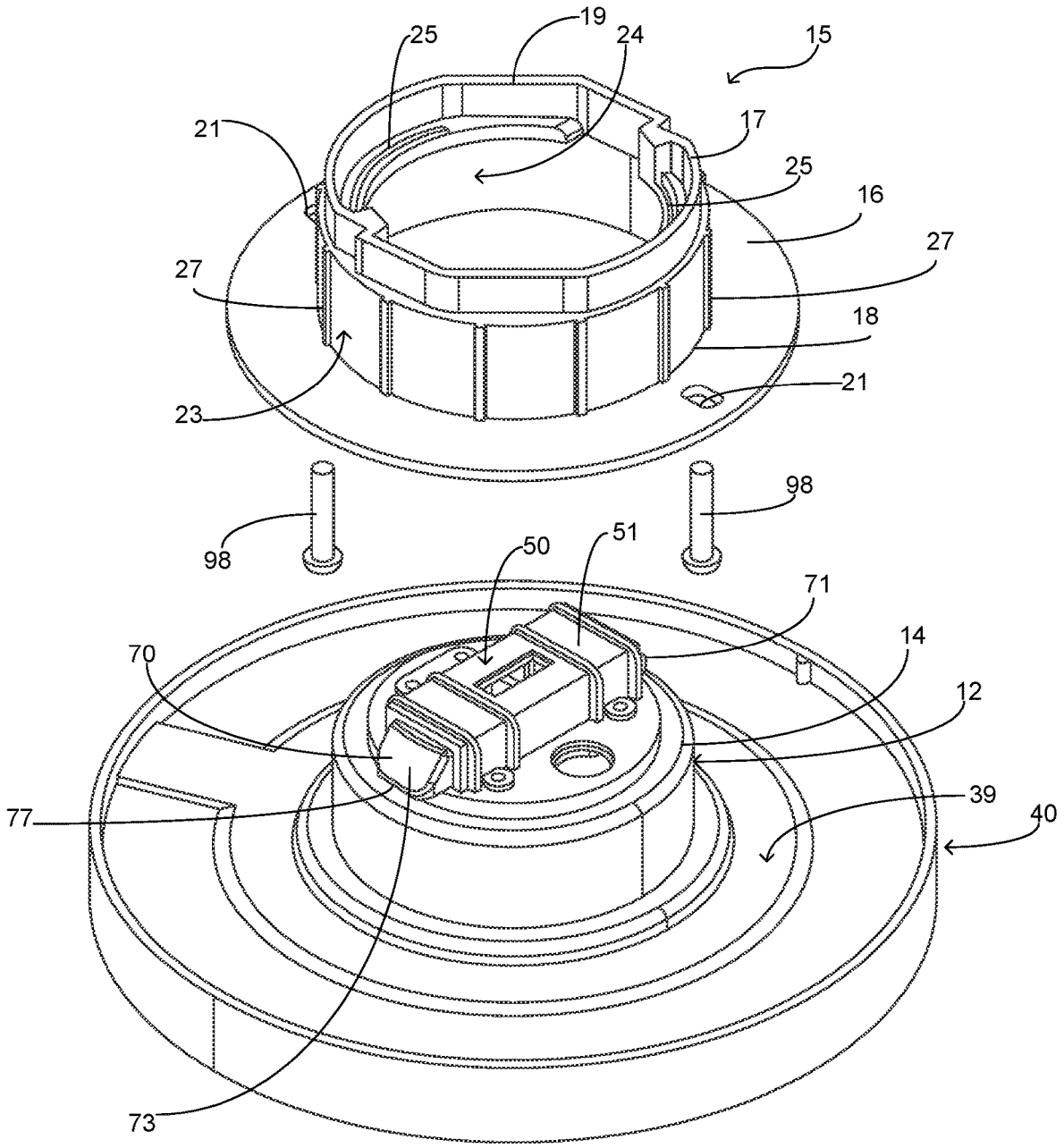
FIG. 1 is a top perspective view of the present invention with the outer ring mount member removed from the mounting assembly.
Figure 2:
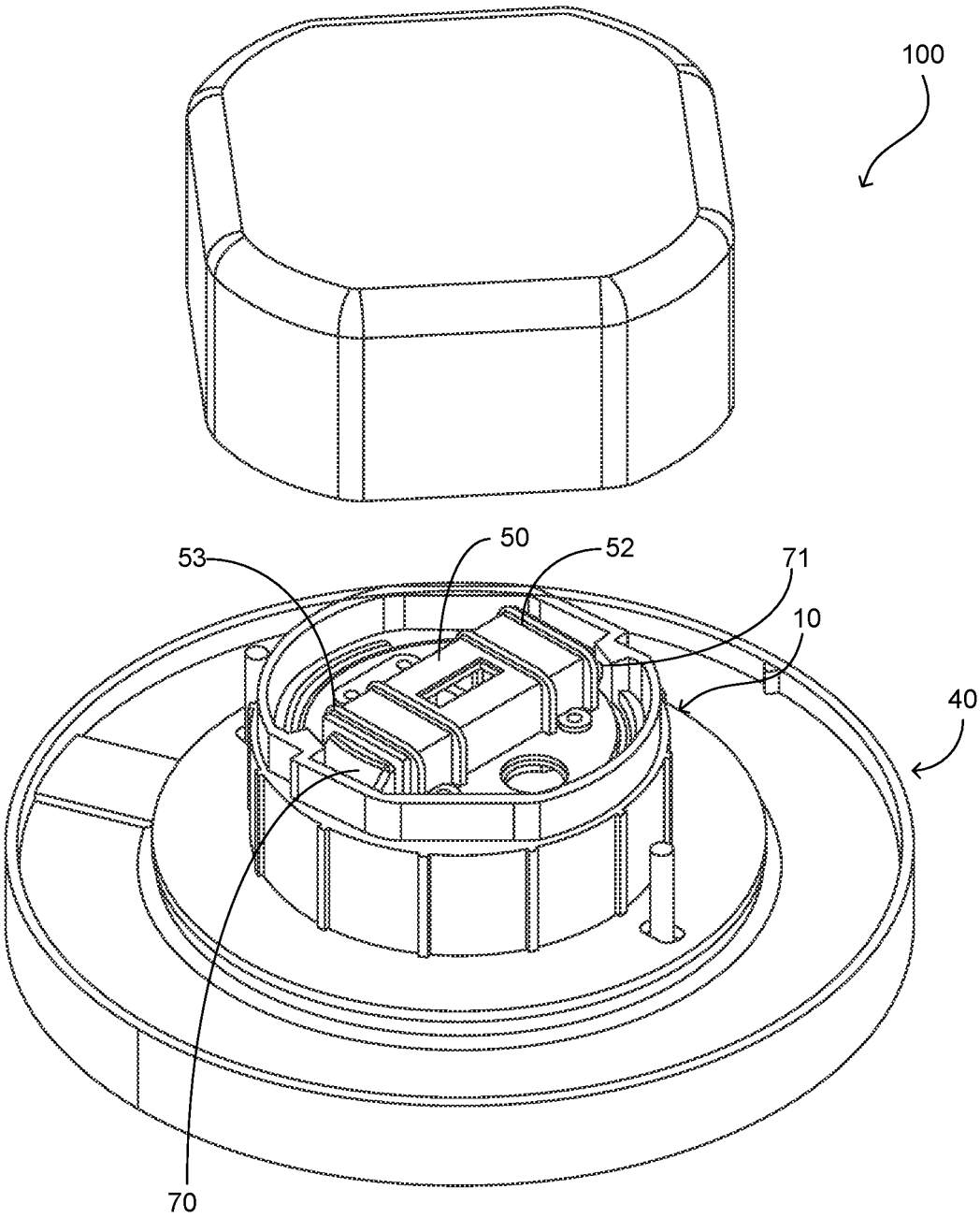
FIG. 2 is a top perspective view of the present invention in an assembled state.
Figure 3:
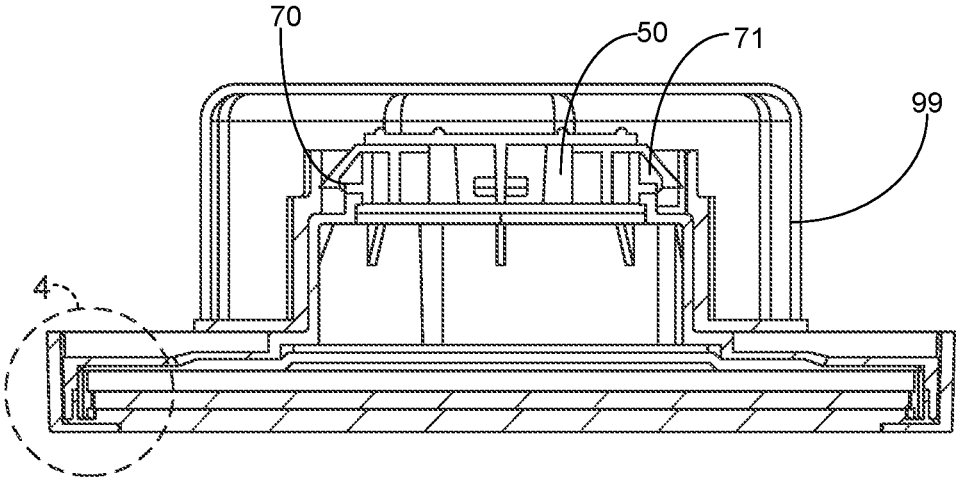
FIG. 3 is a side cross sectional view of the present invention.

References now to the drawings submitted herewith, wherein various elements depicted therein are not necessarily drawn to scale and wherein through the views and figures like elements are referenced with identical reference numerals, there is illustrated a light and mounting assembly 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Now referring to the Figures submitted as a part hereof, the light and mounting assembly 100 includes a mounting assembly 10 and a light housing assembly 40 being integrally formed via suitable techniques. The mounting assembly 10 is configured to operably couple the light and mounting assembly 100 with a standard electrical junction box 99 wherein the aforementioned can be accomplished through frictional engagement or be assisted by mechanical fasteners. The mounting assembly 10 includes an inner housing 12 having wall 14 wherein the wall 14 is annular in shape and is manufactured from a suitable non-conductive material such as but not limited to plastic. The mounting assembly 10 is superposed the upper surface 39 of the light housing assembly 40 and extends upward therefrom. While the mounting assembly 10 is illustrated herein as being annular in shape, it should be understood within the scope of the present invention that the mounting assembly 10 could be formed in alternate shapes.

The mounting assembly 10 has surroundably mounted thereto an outer ring mount member 15. The outer ring mount member 15 is manufactured from a durable rigid material such as but not limited to plastic. The outer ring mount member 15 includes a lower portion 16 and a wall member 17 wherein the lower portion 16 and wall member 17 are integrally formed. The wall member 17 includes a lower edge 18 and upper edge 19 wherein the lower portion 16 is proximate the lower edge 18 and extends outward therefrom and is perpendicular thereto. The lower portion 16 includes apertures 21 that are diametrically opposed and configured to receive fasteners 98 therethrough wherein the fasteners 98 can be utilized to secure to junction box 99. While two apertures 21 are illustrated herein, it should be understood within the scope of the present invention that the lower portion 16 could be configured with less than or more than two apertures.

The wall member 17 of the outer ring mount member 15 includes an outer surface 23 and an inner surface 24. Formed on the inner surface 24 are grooves 25. Grooves 25 are formed in the inner surface 24 of the wall member 17 utilizing suitable techniques. The grooves 25 as is further discussed herein are configured to operably couple with the securing members 70 of the clip assembly 50. The grooves 25 while being illustrated herein as covering only a portion of the inner surface 24 of the wall member 17 are contemplated to be provided in alternate configurations wherein the grooves 25 could be completely disposed around the entire inner surface 24. Outer surface 23 further includes a plurality of longitudinal projections 27 that are integrally formed with the outer surface 23 of the wall member 17. The longitudinal projections 27 extend from the lower edge 18 upwards toward the upper edge 19. The longitudinal projections 27 are circumferentially disposed on the outer surface 23 and are configured to assist in providing a frictional engagement with the junction box 99.

The mounting assembly 19 further includes a clip assembly 50 superposed thereto. The clip assembly 50 facilitates an operable coupling with the outer ring mount member 15. The clip assembly 50 includes a housing 51 that is generally rectangular in shape having a first end 52 and second end 53. The clip assembly 50 has movably secured therein securing members 70,71. The securing members 70,71 are movably mounted within the housing 51 utilizing a spring or other suitable resilient member (not illustrated herein). The securing members 70,71 are secured so as to be biased in an outward direction with respect to the housing 51. The securing members 70,71 are ramp shaped having an inclined upper surface 73. The aforementioned shape allows the securing members 70, 71 to engage the wall member 17 of the outer ring mount member 15 and be biased inwards in order to traverse along the inner surface 24 until reaching the grooves 25 wherein the biased mounting of the securing members 70, 71 will project the leading edge 77 of the securing members 70,71 into the grooves 25 and as such releasably secure the inner housing 12 to the outer ring mount member 15. As the grooves 25 are circumferentially disposed along the inner surface 24, the securing members 70, 71 can be traversed therealong ensuing operable coupling to the grooves 25. The aforementioned allows rotational positioning of the light and mounting assembly 100 ensuing the mounting thereof to the junction box 99. This provides an advantage for certain shapes of the light and mounting assembly 100 especially during installation that include multiple adjacent light and mounting assembly 100. While a preferred embodiment of the clip assembly 50 has been illustrated herein, it is contemplated within the scope of the present invention that the clip assembly 50 could be configured in alternate manners and achieve the desired objective discussed herein. Additionally, while two securing members 70,71 are illustrated and discussed herein, it is contemplated within the scope of the present invention that more than two securing members could be employed that extend outward from alternate sides of the clip assembly 50.

Figure 4:
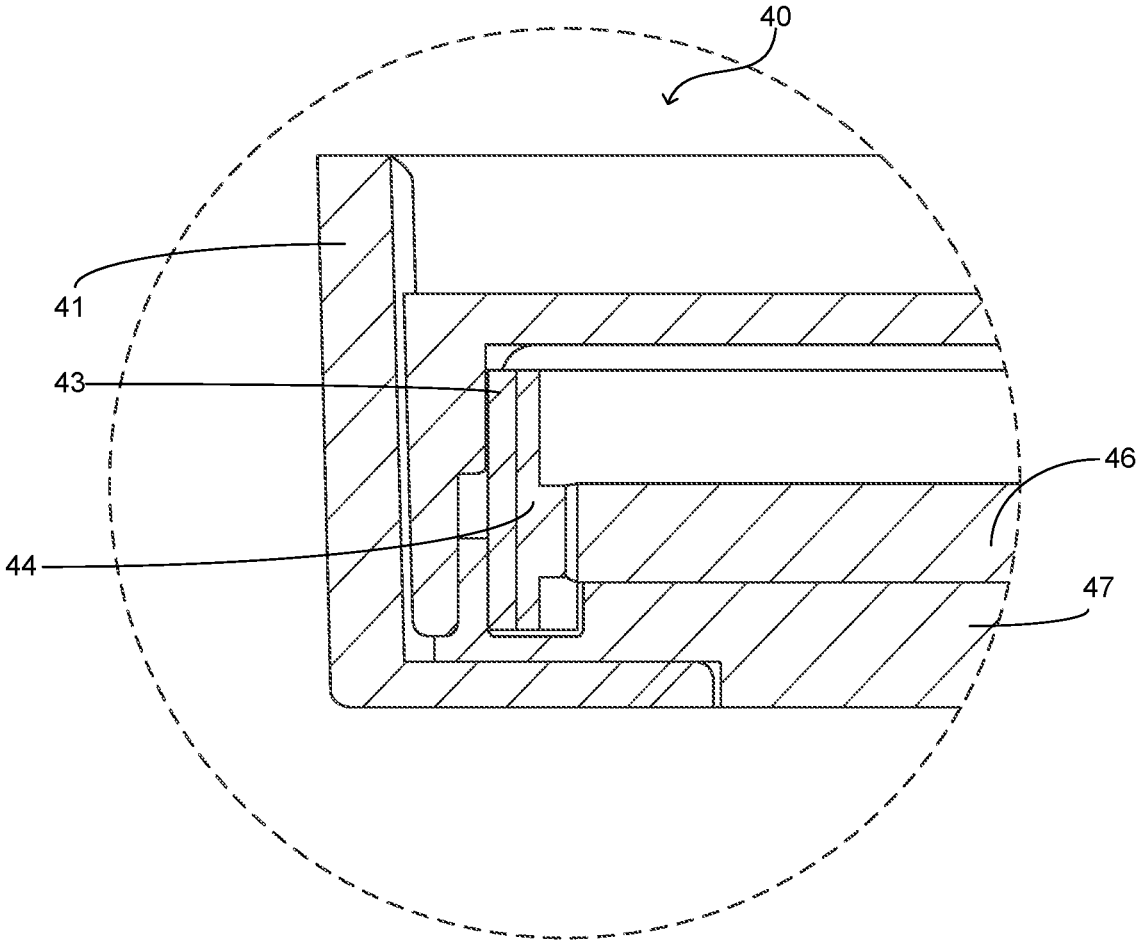
FIG. 4 is a detailed view of the light housing and its components.

A detailed view of the light housing assembly 40 is illustrated herein in FIG. 4. The light housing assembly 40 includes outer housing 41 that is manufactured from a suitable durable material such as but not limited to plastic. In a preferred embodiment the light housing assembly 40 is a low profile LED light but it should be understood within the scope of the present invention that the light housing assembly 40 could be provided in alternate shapes and sizes. Furthermore, it should be understood within the scope of the present invention that the light and mounting assembly 100 could be an alternate lighting type as opposed to a LED light. The light housing assembly 40 includes a reflector member 43 that is manufactured from a suitable reflective material such as but not limited to aluminum. Adjacent to the reflector member 43 is LED light member 44. The led light member 44 is manufactured from conventional LED tape. The LED light member 44 is adjacent to and operably coupled with the light guide member 46. The light guide member 46 is manufactured from a suitable material such as but not limited to clear acrylic and is configured to direct light emissions from the LED light member 44. A diffuser lens 47 is adjacent and immediately below the light guide member 46. The diffuser lens 47 is manufactured from a suitable material such as but not limited to frosted acrylic and is operable to collect and smooth light emissions from the light and mounting assembly 100 so as to eliminate hot spots ensuring an even distribution of light emitting from the light and mounting assembly 100. In a preferred embodiment of the present invention the light housing assembly 40 is a low profile design wherein the thickness thereof does not exceed two inches.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding description is, therefore, not intended to be limited to the specific forms set forth herein, but on the contrary, it is intended to cover such alternatives, modifications, and equivalents, as can be reasonably included within the spirit and scope of the invention.

What is claimed is:

1. A light and mounting assembly configured to be operably coupled to an electrical junction box, wherein the light and mounting assembly comprises:

a light housing assembly, said light housing assembly having an outer housing, said outer housing having an interior volume, said light housing assembly having an upper surface, said light housing assembly having at least one light source disposed in the interior volume;

a mounting assembly, said mounting assembly being positioned on the upper surface of the light housing assembly, said mounting assembly having an inner housing, said mounting assembly further having an outer ring mount member, said outer ring mount member having a wall member, said wall member having an inner surface and an outer surface, said outer ring mount member being circumferentially disposed around said inner housing, said outer ring mount member configured to be operably coupled to the electrical junction box; and a clip assembly, said clip assembly being positioned on an upper surface of the inner housing of said mounting assembly, said clip assembly having a housing, said clip assembly having a first end and a second end, said clip assembly having at least two securing members wherein said at least two securing members extend outward from the housing of said clip assembly so as to engage a portion of the inner surface of the wall member of said outer ring mount member.

2. The light and mounting assembly as recited in claim 1, and further including at least one groove, said at least one groove being formed in said inner surface of said wall member of said outer ring mount member, said at least one groove operable to be engaged by a portion of the at least two securing members.

3. The light and mounting assembly as recited in claim 2, wherein said outer ring mount member further includes a lower portion, said lower portion being proximate a bottom end of said wall member of said outer ring mount member, said lower portion being perpendicular to said wall member and extending outward therefrom.

4. The light and mounting assembly as recited in claim 3, wherein the at least two securing members are ramp shaped having an inclined upper surface, said at least two securing members having a leading edge.

5. The light and mounting assembly as recited in claim 4, wherein the leading edges of the at least two securing members are configured to operably engage the at least one groove on said inner surface of said wall member of said outer ring mount member.

6. The light and mounting assembly as recited in claim 5, and further including a plurality of longitudinal protrusions, said plurality of longitudinal protrusions being formed on said outer surface of said wall member of said outer ring mount member.

7. The light and mounting assembly as recited in claim 6, wherein the light and mounting assembly is rotationally positionable subsequent operable coupling with the electrical junction box.

8. A light and mounting assembly configured to be operably coupled to an electrical junction box and rotationally positionable ensuing coupling, wherein the light and mounting assembly comprises:

a light housing assembly, said light housing assembly having an outer housing, said outer housing having an interior volume, said light housing assembly having an upper surface, said light housing assembly having a LED light tape disposed in the interior volume, said light housing assembly further including a reflector member and a light guide member;

a mounting assembly, said mounting assembly being positioned on the upper surface of the light housing assembly, said mounting assembly having an inner housing, said mounting assembly further having an outer ring mount member, said outer ring mount member having a wall member, said wall member having an inner surface and an outer surface, said wall member having a bottom edge and an upper edge, said outer ring mount member further having a lower portion contiguously formed with said wall member, said lower portion being proximate said bottom edge of said wall member, said lower portion being perpendicular to said wall member and extending outward therefrom, said outer ring mount member being circumferentially disposed around said inner housing, said outer ring mount member configured to operably coupled to the electrical junction box;

at least one groove, said at least one groove being formed on the inner surface of said wall member of said outer ring mount member;

a clip assembly, said clip assembly being positioned on an upper surface of the inner housing of said mounting assembly, said clip assembly having a housing, said housing of said clip assembly being rectangular in shape, said clip assembly having a first end and a second end;

a first securing member and a second securing member, said first securing member and said second securing member being movably mounted within said housing of said clip assembly and having a portion extending outward therefrom, said first securing member being located at said first end of said housing of said clip assembly, said second securing members being located at said second end of said housing of said clip assembly.

9. The light and mounting assembly as recited in claim 8, wherein the portion of said first securing member and said second securing member extending outward from said housing of said clip assembly is ramp shaped having an inclined surface.

10. The light and mounting assembly as recited in claim 9, wherein the portion of said first securing member and said second securing member includes a leading edge wherein the leading edge is configured to operably couple to said at least one groove and be slidably traversed therein.

11. The light and mounting assembly as recited in claim 10, and further including a plurality of longitudinal protrusions, said plurality of longitudinal protrusions being formed on said outer surface of said wall member of said outer ring mount member, said plurality of longitudinal protrusions being intermediate said bottom edge and said upper edge of said wall member of said outer ring mount member.

12. The light and mounting assembly as recited in claim 11, wherein the light is a low profile LED light.

* * * * *